United States Patent [19]

Schlosberg

[11] 4,074,752

[45] Feb. 21, 1978

[54] LUBRICANT COOLING APPARATUS

[75] Inventor: Seymour Schlosberg, East Brunswick, N.J.

[73] Assignee: R. Gelb & Sons, Inc., Union, N.J.

[21] Appl. No.: 643,480

[22] Filed: Dec. 22, 1975

[51] Int. Cl.[2] ..... F01M 5/00; F28F 27/00

[52] U.S. Cl. ..... 165/96; 165/106; 184/6.22; 184/104 R; 277/15

[58] Field of Search ..... 277/22, 15; 184/6.22, 184/104 R; 165/154, 96, 106

[56] References Cited

U.S. PATENT DOCUMENTS

| | | | |
|---|---|---|---|
| 2,328,698 | 9/1943 | Wiessner | 277/15 |
| 2,915,292 | 12/1959 | Gross | 165/89 |
| 3,005,518 | 10/1961 | Jassniker | 277/15 X |
| 3,291,489 | 12/1966 | Tracy et al. | 277/22 X |
| 3,357,706 | 12/1967 | Wilkinson | 277/22 X |
| 3,474,513 | 10/1969 | Allingham | 165/154 X |
| 3,489,419 | 1/1970 | Stratienko | 277/22 X |
| 3,578,067 | 5/1971 | Schlosberg | 165/39 |
| 3,667,766 | 6/1972 | Sussmeyer | 277/22 |
| 3,775,062 | 11/1973 | Susuki et al. | 165/15 X |

FOREIGN PATENT DOCUMENTS

| | | | |
|---|---|---|---|
| 80,812 | 7/1934 | Sweden | 165/96 |

*Primary Examiner*—Irwin C. Cohen
*Attorney, Agent, or Firm*—Pennie & Edmonds

[57] ABSTRACT

An apparatus for circulating and cooling a liquid lubricant utilized for lubricating an external device such as a mechanical seal. A housing has an internal lubricant reservoir and at least one peripheral outer sidewall with axially spaced and lower end wall portions in sealed relation with the peripheral outer sidewall. A cooling chamber is disposed about at least a portion of the internal reservoir and within the housing in communicating relation with the internal reservoir and is formed at least in part by the outer peripheral sidewall such that heat is transferable from within the chamber to an outside atmosphere. The apparatus also includes lubricant return means and feed means, the lubricant return means being at a level higher than the lubricant feed means such that lubricant which is returned from the mechanical seal to the cooling chamber flows downwardly therewithin — by natural convection and gravity — to the feed means so as to be directed back to the mechanical seal to provide further lubrication. Means for introducing a gaseous medium under elevated pressures into the reservoir serves to raise the level of the lubricant in the cooling chamber sufficiently to enable adequate heat transfer to take place through the peripheral outer sidewall and to insure a closed liquid loop which permits continuous convectional flow regardless of the level in the reservoir.

24 Claims, 6 Drawing Figures

LUBRICANT COOLING APPARATUS

BACKGROUND OF THE INVENTION

1. Field of the Invention

The present invention generally pertains to liquid cooling devices. In particular, it relates to a lubricant cooling apparatus for cooling lubricant or the like used for an external device, such as a mechanical-type seal.

2. Description of the Prior Art

In industry there are numerous situations wherein materials are contained in a container such as a reactor vessel at superatmospheric pressures and are acted upon through rotating or even reciprocating shafts. Consequently, the pressurized vessel must retain the pressurized material without leakage as well as to enable lubricants to flow to the moving shaft to provide lubrication for the latter. Conventional approaches which have been taken in the field for the purposes of preventing leakage which also providing for a sufficient supply of lubricant to the shaft include, for example, stuffing boxes and double mechanical seals. Although double mechanical seals have been in widespread use and generally suitably serve such purposes, they nevertheless suffer from the shortcoming of not being able to effectively cool the lubricant employed.

One heretofore known attempt to adequately and effectively cool such lubricant includes cooling of lubricant by positive water circulation; however, this approach requires the use of a separate water circulation system. Another attempt to overcome the known shortcomings associated with cooling the lubricant in a double seal arrangement was directed to the use of natural convection cooling of the lubricant under pressure. However, this attempt required the assistance of a rather bulky and expensive heat exchanger. Similarly, other known techniques and devices for cooling the lubricant were found to be inadequate by reason of their bulk or operational and construction expense.

A particularly successful approach employed for overcoming the theretofore known difficulties was a Self-Cooling Mechanical Seal Lubricator disclosed in my U.S. Pat. No. 3,578,067, closed May 11, 1971. The Self-Cooling Mechanical Seal Lubricator disclosed in my patent is highly efficient, compact, and at the same time, inexpensive. Moreover with my developement, sufficient quantities of cooled lubricant were available for circulation, and loss of lubricant did not adversely affect cooling efficiency. Despite the rather significant advance in the state of the art provided by this Self-Cooling Seal Lubricator, it was not, in general, as simplified in construction and as economical as could otherwise have been desired.

Accordingly, I have invented a novel and improved self-cooling lubricator apparatus which is structurally less complicated and more economical in construction and use than heretofore known devices. While the present inventive apparatus may cool lubricants and the like, it nevertheless provides a cooling capacity which is at least equivalent to, if not better than the prior art devices.

SUMMARY OF THE INVENTION

An apparatus for circulating and cooling a liquid utilized for use in an external device. The external device may be of numerous devices requiring a liquid for lubrication or cooling during operation; however in the preferred embodiment the external device is a mechanical seal assembly which utilizes a liquid lubricant. The inventive apparatus comprises a housing for an internal lubricant reservoir and at least one peripheral outer sidewall. The housing has axially spaced upper and lower end wall portions, and a cooling chamber disposed about at least a portion of the internal reservoir and within the housing. The cooling chamber communicates with the internal reservoir and is formed at least in part by the outer peripheral sidewall such that heat is transferable from within the cooling chamber to an atmosphere outside of the housing. Lubricant return means connected to the peripheral sidewall operatively communicates with the cooling chamber for directing relatively hot lubricating liquid from said external device to said cooling chamber and lubricant feed means operatively connected to a lower portion of said housing enables relatively cooled lubricating liquid flowing downwardly within the cooling chamber to return to the external device to provide further lubricating thereof. The apparatus further comprises means for introducing a gaseous medium under relatively elevated pressures into the reservoir to raise the lubricating liquid in the cooling chamber to a level sufficient to enable adequate heat transfer to take place from the lubricating liquid returning to the cooling chamber from the external device. The lubricating liquid is circulated by natural convection in a generally closed liquid system thereby insuring continuous cooling thereof in the cooling chamber.

A feature of the invention resides in the provision of a cooling chamber within the housing and outside of the reservoir, while being formed at least in part by the outer peripheral sidewall of the housing. The efficiency of heat transfer is so improved by this arrangement that the circulated liquid is cooled in a substantially improved manner. Also, this arrangement facilitates the addition of a plurality of different types of heat transfer aids such as fins, cooling jackets, external or internal cooling coils and the like. Such cooling jackers or coils would be adapted to carry a cooling medium which significantly improves the heat transfer capabilities of the apparatus.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

For the purposes of the present description the apparatus of the invention will be described in use with a mechanical seal assembly for a rotatable shaft. However, it should be understood that the invention may be utilized with any external device requiring lubrication by means of a liquid lubricant which must be periodically cooled.

Figure 1:
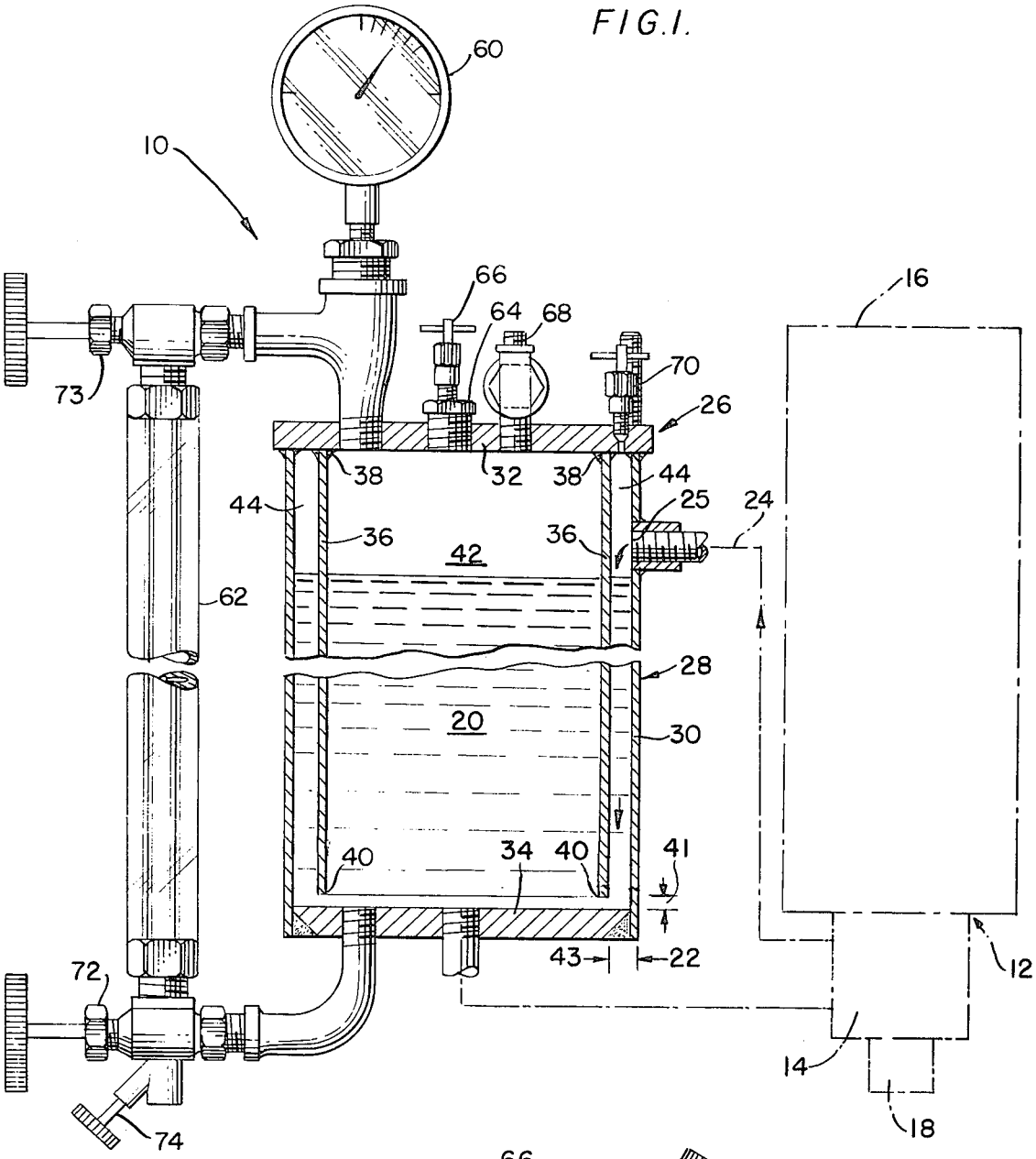
FIG. 1 is a side elevational view partly in section which illustrates the embodiment of the lubricant circulating and cooling apparatus of the present invention.

Referring to the drawings and, in particular, to FIG. 1, there is illustrated a novel and improved lubricant cooling apparatus embodying the principles of the present invention and generally designated by reference numeral 10. The lubricant cooling apparatus 10 is operatively connected, in a manner to be hereinafter explained, to a conventional form of mechanical seal assembly shown schematically at reference numeral 12. Since the seal assembly 12 does not form part of the present invention, and since it is considered to be conventional, the details as to its precise structure and function are dispensed with. It should be understood, however, that the seal assembly 12 essentially includes a mechanical seal (not shown) which is appropriately supported within a seal housing 14. A container or reactor vessel 16 and the like may have operatively associated therewith a rotatable shaft 18 and the mechanical seal serves to allow lubricant 20 to flow between the rotatable shaft 18 and seal housing 14. Ordinarily, such lubricant 20 is applied under a predetermined pressure to the mechanical seal such that this pressure exceeds that of the pressurized material conveniently stored or worked upon within the vessel or container 16. In such a manner, the lubricant 20 serves to prevent leakage of the container contents. Thus for the purposes of the present invention, lubricant operating pressure will depend upon the specific use contemplated.

The friction which is normally generated by shaft 18 correspondingly results in a substantial amount of heat at the seal assembly 12 with the lubricant 20 also being heated. To reduce the adverse effects of the heat on the lubricant, this invention operatively fluidically connects the self-cooling apparatus 10 to the seal assembly 12 through a pair of lubricant return and feed lines, 24 and 22 respectively, and enables the lubricant 20 to flow continuously in a generally closed liquid loop system which results in a convectional circulation of the lubricant regardless of the level in the reservoir. This flow actually causes the lubricant to be returned to the seal assembly 12 to provide further lubrication thereof.

Figure 2:
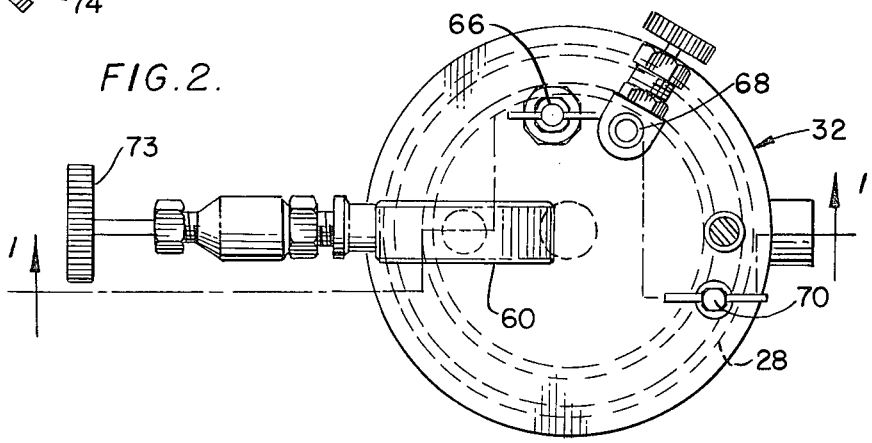
FIG. 2 is an end view of the lubricant cooling apparatus of FIG. 1.

Referring further to FIG. 1 in conjunction with FIG. 2, the lubricant cooling apparatus 10 is shown as being defined by a container 26 which is preferably an enclosed fluid-tight, cylindrical member 28 having a peripheral sidewall 30 and axially spaced upper and lower end walls, 32 and 34, respectively. A generally elongated internal tubular member is defined by peripheral sidewall 36 spaced inwardly of the outer sidewall 30 and has opposed upper and lower end portions 38 and 40, respectively. Tubular member 36 is generally centrally and concentrically disposed within the cylindrical member 28, and the upper end portion 38 is secured — preferably by welded seams as shown — in a fluid-tight relation to the inner surface of upper end wall 32. Lower end portion 40 of tubular member 36 is vertically spaced by an appropriate distance 41 from the inner surface of lower end wall 34, while sidewall 36 is spaced inwardly from outer peripheral sidewall 30 of the container by a distance 43. The particular significance of such spacing will be explained in further detail below.

The arrangement of the inner tubular member 36 with respect to outer cylindrical member 28 serves to define an inner reservoir chamber 42 within the confines of the tubular member 36 which will receive any suitable type of fluid medium or lubricant 20. Such tubular member 36 additionally serves to define an inner portion of a generally annular cooling chamber 44 between sidewall 36 and the interior surface of peripheral wall 30 and this chamber is suitable for purposes of cooling the lubricant 20 as will be seen. Cooling chamber 44 enables heat to transfer between lubricant 20 and the ambient outside atmosphere surrounding the container 26. As previously mentioned, the vertical space 41 between the inner surface of lower end wall 34, as well as the bottom open end portion 40 of tubular member 36, facilitates fluidic communication between cooling chamber 44 and reservoir chamber 42 during the normal operation of apparatus 10. By reason of such communication, the heated lubricant 20, which returns from the seal assembly 12 through return line 24, enters the cooling chamber 44 through lubricant return opening 25 and eventually cools and recirculates by natural convection and gravitational forces to be directed back to seal assembly 12 through feed line 22.

Air pressure gauge 60 is connected to the upper end wall 32 of the housing as shown. A sight glass 62 indicates the fluid level in the housing. A reservoir plug 64 is selectively removable for introducing lubricant into the reservoir and a reservoir vent valve 66 facilitates selective venting of the reservoir. Needle valve 68 permits pressurization of the reservoir and valve 70 permits venting of the cooling chamber 44.

In operation pressurization valve 68 is initially verified to be in the closed position. Thereafter cooling chamber vent valve 70 is opened and reservoir plug 64 (with vent valve 66) is removed. Gauge valves 72 and 73 on sight glass 62 are verified to be in their open positions with drain cock 74 in the closed position. Thereafter the reservoir is charged with lubricating liquid (i.e., oil, etc.) through the reservoir plug fill port until the level in the sight glass reaches a predetermined height (i.e., preferably one-half to two-thirds of the reservoir). Cooling chamber vent valve 70 is then closed and plug 64 is reinstalled with reservoir vent valve 66 verified to be closed.

Figure 3:
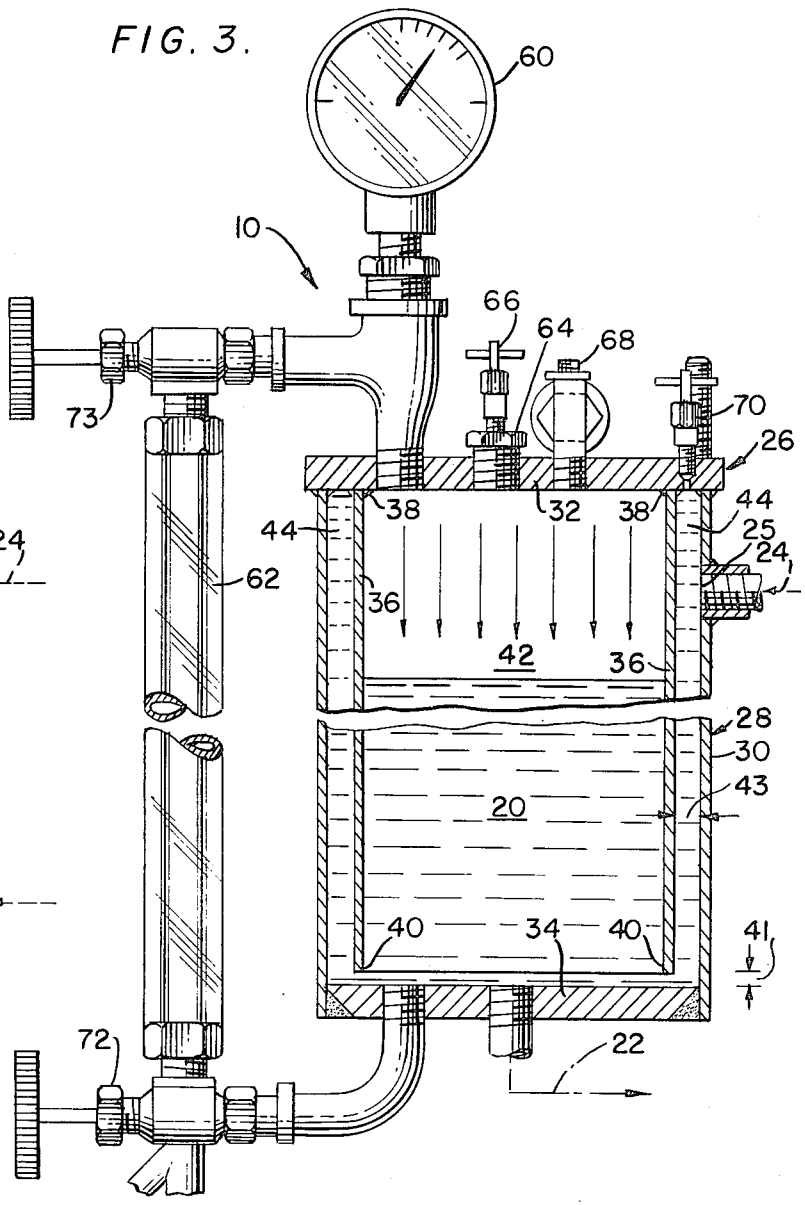
FIG. 3 is a side elevation, partly in section, of the lubricant cooling apparatus of FIG. 1 with the inner lubricant reservoir in a pressurized state.

A source of pressurized gas such as a factory air pressure line or gas bottle is attached to pressurization needle valve 68 which is thereafter opened slowly to introduce the gas (shown schematically at 74 in FIG. 3) to pressurize the reservoir to a predetermined level. For example, approximately 50 pounds per square inch gauge pressure (psig) above the maximum intended operating pressure of the reactor vessel 16 has been found to be useful as a reservoir pressure.

Air or gas is then bled off from the cooling chamber 44 by opening vent valve 70 at least until the lubricating liquid surpasses the level of opening 25, but preferably until lubricating fluid appears through vent valve 70. At this point vent valve 70 is closed tightly and the liquid level in the cooling chamber 44 will have reached a level sufficient to enable adequate transfer of heat from the returned lubricant and to define a closed liquid loop. It should be appreciated that since the pressurized air or gas is acting on the lubricant 20 in the reservoir chamber 42, the lubricant level in the reservoir 42 is lower than the pre-pressurization level, and the lubricant level in the cooling chamber 44 will remain substantially constant regardless of fluctuations of the fluid level in the reservoir. This constant level is, of course, only maintained if the level of lubricant 20 in the reservoir remains above the lower end portion 40 of the tubular member 36. Thus with a sufficient quantity of lubricant remaining in the cooling chamber 44, adequate heat transfer from the lubricant in the cooling chamber is assured.

The lubricant 20 from the seal assembly 12 is returned to the apparatus 10 via return line 24. The hotter fluid flows from return line 24 into opening 25, and — due to its lesser density — upwardly into the cooling chamber. Because of the existence of a closed liquid loop, the lubricant then flows gradually downwardly as it cools and its density increases. Thus the cooling and circulation is caused by a natural convenctional flow. During this downward movement heat is transferred to the surrounding ambient atmosphere through the wall 30 which forms the external portion of the cooling chamber 44. Consequently by virtue of the foregoing, the lubricant 20 cools and the variations of density causes the fluid to circulate until it reaches feed line 22 to be returned to the seal assembly 12. To assist in such heat transfer, the surrounding atmosphere may utilize force circulated air over the container 26.

It can be seen that the present development makes it possible to cool any lubricating liquid in a manner which is clearly more efficient than the techniques of the prior art while utilizing a structural arrangement which is relatively less complex and less costly.

Figure 4:
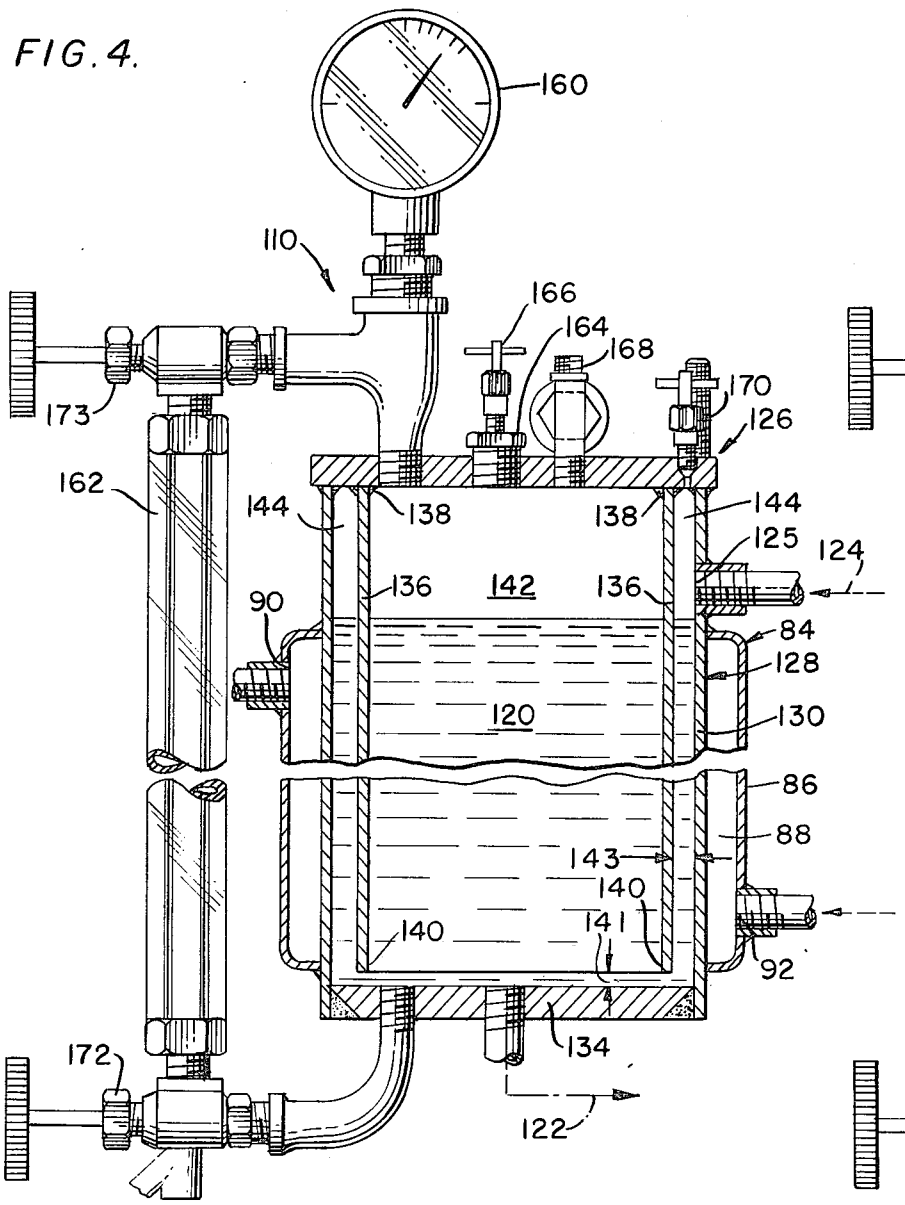
FIG. 4 is a side elevation, partly in section, of an alternate embodiment of the lubricant cooling apparatus of the present invention utilizing an external cooling jacket.

Referring to the second embodiment of the instant invention as illustrated in FIG. 4, it should be pointed out that those parts corresponding to parts of the previously described embodiment have been designated by similar reference numerals with the addition, however, of the prefix 1. In this embodiment, self-cooling apparatus 110 is constructed in a manner similar to that described above with the preceding embodiment. It is envisioned by the present invention that self-cooling apparatus 110 may be provided with an additional cooling means 84 for purposes of enhancing the cooling capacity of the apparatus 110. Cooling means 84 is defined by an annular jacket 86 which is spaced from and, preferably, completely encompasses the outer peripheral sidewall 130 of the container 126, particularly between lubricant return opening 125 and lower end wall 134. Annular jacket 86 defines a second cooling chamber 88 which further facilitates the dissipation of heat from the hot lubricant 20 as the lubricant enters cooling chamber 144. The annular jacket 86 is preferably secured to the peripheral sidewall 130 by welded joints as shown. In addition, the annular jacket 86 is provided with a pair of coolant inlet and outlet openings 90 and 92, respectively which are appropriately connected to a source (not shown) capable of supplying a suitable type of coolant fluid through second coolant chamber 88. It is within the spirit and scope of the present invention that the annular jacket 86 may enable the continuous flow therethrough of a coolant medium or retain a suitable coolant material therein. Accordingly, it will be appreciated that self-cooling lubricating apparatus 110 essentially functions in a similar manner to that of self-lubricating apparatus 10 as described in the first embodiment.

Figure 5:
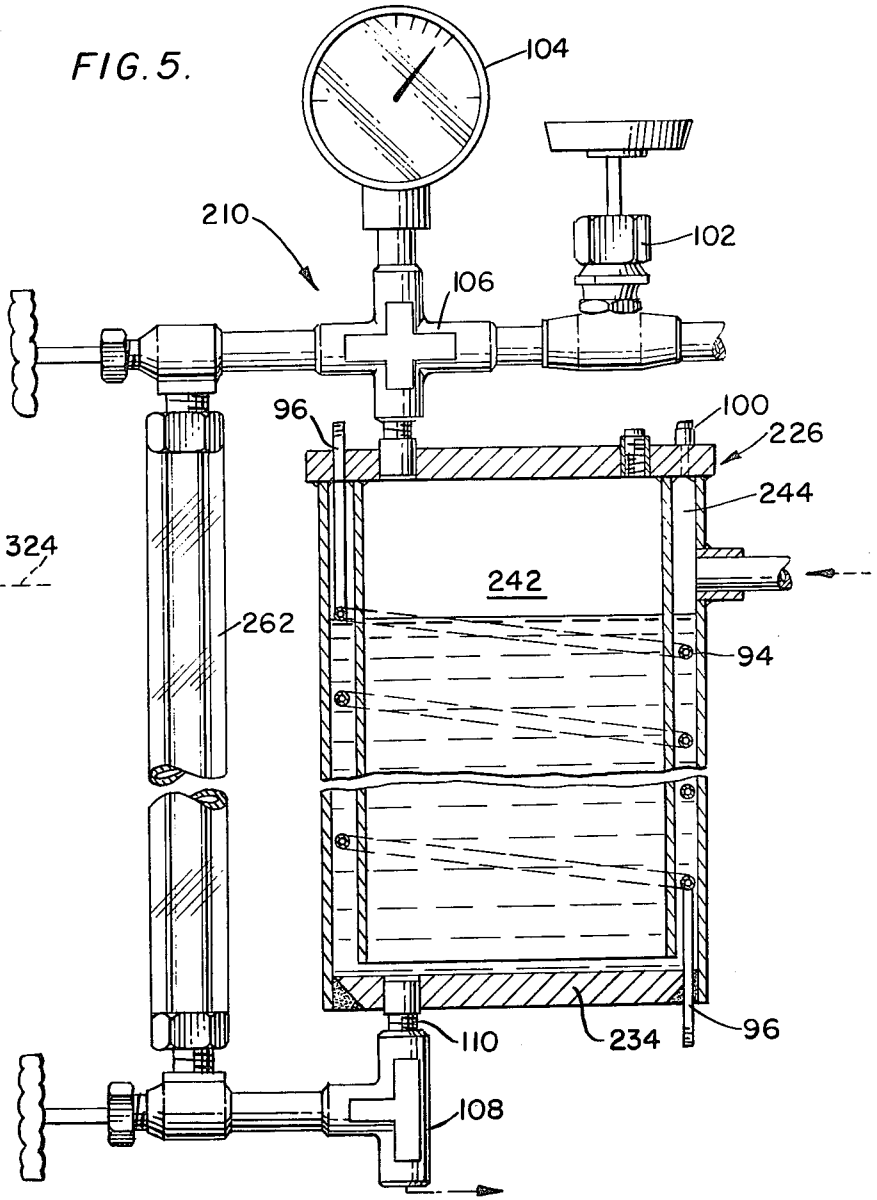
FIG. 5 is a side elevation, partly in section, of another ambodiment of the lubricant cooling apparatus of the invention utilizing a cooling coil disposed within the apparatus and an alternate arrangement for filling and pressurizing the system.

With reference to FIG. 5, there is disclosed another embodiment of the present invention which is similar to the first embodiment. Accordingly, like structure has been designated by similar reference numerals with the addition, however, of a prefix 2. The cooling means of this embodiment is defined by a coolant coil 94 which is suitably disposed within the cooling chamber 244. As depicted in the illustrated embodiment, the coil 94 is suitably wrapped about the peripheral wall of the tubular member 236 and extends through the length of the cooling chamber 244. The coil turns are preferably positioned in the area situated between the lubricant return opening and the lower end wall 234 of the container 226. The coolant coil 94 has its opposite free ends extending through apertures 96 formed within upper and lower end walls 232 and 234 respectively for purposes of allowing the continuous flow-through of coolant medium; such as, for example, air water or other appropriate fluid. The coolant medium, of course, serves to enhance dissipation of heat from the heated lubricant 20 which enters within the cooling chamber 244 and thereby improves the cooling capacity of the lubricant cooling apparatus 210. As with the preceding embodiments, this particular lubricant cooling apparatus operates and functions in a similar manner.

The lubricant fill and pressurization structure of the embodiment of FIG. 5 is also alternately arranged, but it should be understood that this arrangement may be utilized with the other embodiments of the invention, while the additional cooling feature of the embodiment of FIG. 5 may be utilized as well with the fill/pressurization arrangement of the apparatus of FIG. 1.

Referring to FIG. 5, fill plug 98 is removable for the purposes of introducing lubricant to the reservoir 242 and cooling chamber 244 has communicating therewith, a venting valve 100. Air or gas is introduced under pressure into the reservoir 242 via pressurization valve 102 which selectively communicates a source of pressurized air or bottle gas (not shown) with the reservoir 242 and with a pressure gauge 104. Pressure gauge 104 is in turn connected via cross coupling 106 to the sight glass 262 and the pressurization valve 102. A tee-coupling 108 connects the cooled fluid return line 110 to the lower end portion of the sight glass 262 as well as to the return line of the type shown at 22 of FIG. 1 which re-directs the cooled and circulated lubricant back to the mechanical seal or other external device. Although the structural arrangement of the fill/pressurization system is shown in FIG. 5 is an alternate arrangement, the functional and operational operation is equivalent to the arrangement of FIG. 1.

Figure 6:
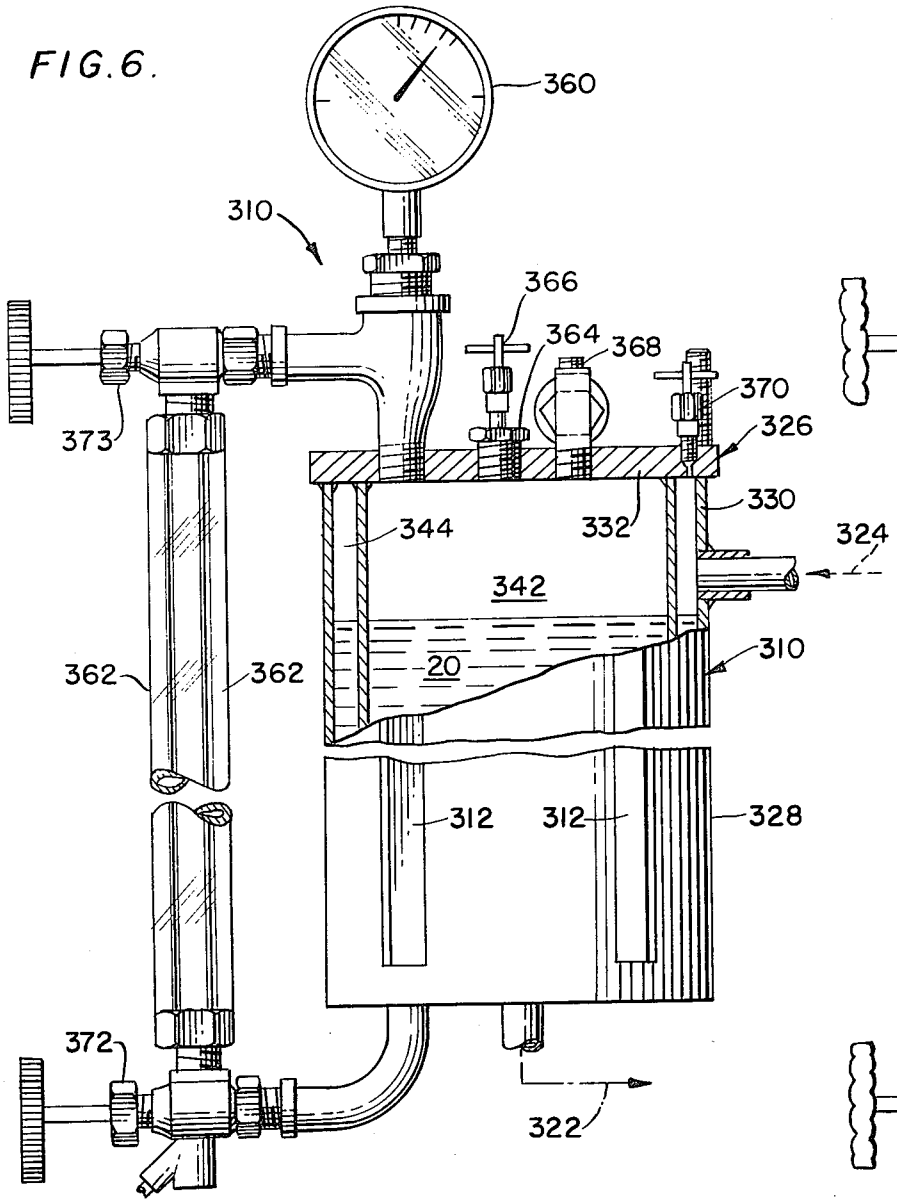
FIG. 6 is a side elevation, partly in section, of still another embodiment of a self-cooling apparatus of the invention utilizing external cooling fins.

The third embodiment of the present invention is similar to the embodiment of FIG. 1 and, therefore, like structure will be designated by like reference numerals with the exception, however, of a prefix 3. As shown in FIG. 6, cooling means 110 of this particular self-cooling apparatus 310 is defined by a plurality of circumferentially spaced and radially extending fins 112 which are secured in a conventional manner to the exterior surface of the peripheral sidewall 330. Finds 112 may extend from between the lubricant return opening 380 and lower end wall 334 of the self-cooling apparatus 310. Fins located in this position serve the purpose of further enhancing dissipation of heat from the heated lubricant 20 in the cooling chamber 344 after it returns from the seal assembly 12 through the lubricant return opening 380. Correspondingly, of course, the cooling capacity of the apparatus 310 is improved. While a plurality of fins 112 are generally positioned about the peripheral sidewall 330, other known forms and arrangements of heat dissipation devices may be employed without departing from the spirit and scope of the present invention.

Although the present invention has disclosed various means to additionally improve heat transfer from the heated lubricant to outside the container means, it will be understood that it is envisioned within the spirit and scope of the instant invention that other means may be provided in association with the peripheral sidewall and self-cooling apparatus so as to increase the amount of heat transferred.

In the above described arrangements of self-cooling devices, through use of a cooling chamber external to the internally pressurized reservoir, a condition results wherein there is a relatively more effective self-cooling of the lubricant in a reliable and effective manner and with a relatively simple and inexpensive structure.

While the invention has been described in connection with the above embodiments, it is not intended to limit the invention to the particular forms as set forth above, but, on the contrary, it is intended to cover such alternatives, modifications and equivalents, as may be included within the spirit and scope of the invention as defined by the appended claims.

I claim:

1. An apparatus for circulating and cooling a liquid medium utilized for lubricating an external device, comprising a housing having means defining an internal lubricant reservoir and including at least one peripheral outer sidewall, axially spaced upper and lower end wall portions, a cooling chamber disposed about at least a portion of the internal reservoir and within the housing, said means defining said reservoir being formed such that said chamber is in fluidic communicating relation with the internal reservoir said chambers being formed at least in part by said outer peripheral sidewall such that heat is transferable from within said cooling chamber to an atmosphere outside of the housing, lubricant return means connected to an upper portion of said peripheral sidewall and operatively communicating with said cooling chamber for directing relatively hot lubricating liquid from an external device to said cooling chamber, lubricant feed means operatively connected to a lower portion of said housing to enable relatively cooled lubricating liquid flowing downwardly within said cooling chamber to return to an external device to provide further lubrication thereof, and means for introducing a gaseous medium under relatively elevated pressures into said reservoir to raise the lubricating liquid in the cooling chamber to a level sufficient to enable adequate heat transfer to take place from the lubricating liquid returning to said cooling chamber from an external device, said lubricating liquid being circulated by natural convection in a closed liquid system.

2. The apparatus according to claim 1 further comprising further cooling means operatively associated with said cooling chamber for increasing the transfer of heat from heated lubricant therewithin to said outside atmosphere.

3. The apparatus according to claim 2 wherein said further cooling means comprises a cooling jacket which at least partially surrounds said peripheral sidewall portion of said housing between said lubricant return means and the lubricant feed means at the lower portion of said housing, said cooling jacket being configured and disposed to receive a cooling medium to enhance the dissipation of heat from said housing to the outside atmosphere.

4. The apparatus according to claim 2 wherein said cooling means comprises at least one cooling fin secured to said peripheral outer sidewall of said housing and capable of increasing heat transfer from liquid within said cooling chamber to said outside atmosphere.

5. The apparatus according to claim 4 further comprising a plurality of cooling fins connected to said outer peripheral sidewall of said housing to improve heat transferred from said cooling chamber to the outside atmosphere.

6. The apparatus according to claim 4 wherein said fins extend along the length of said housing and are radially positioned relative to the central portion thereof.

7. The apparatus according to claim 2 further comprising a cooling coil positioned within said cooling chamber and extending therethrough, said cooling coil being capable of receiving a circulating cooling medium within said cooling chamber to increase the heat transfer from the hot lubricating liquid in said cooling chamber.

8. The apparatus according to claim 1 wherein said housing is a generally tubular member having end wall portions secured in fluid-tight relation thereto.

9. The apparatus according to claim 8 wherein said internal liquid reservoir means is defined by a generally tubular member of lesser diameter than the peripheral sidewall of the housing so as to define said cooling chamber within the housing and surrounding the reservoir, said internal tubular member having one end portion secured in fluid-tight relation to the inner surface of the upper end wall of said housing, the other end portion being free.

10. The apparatus according to claim 9 wherein the free end portion of said internal generally tubular member is spaced a predetermined distance upwardly from the inner surface of the lower end wall portion to facilitate operative communicating relation between said peripheral cooling chamber and said internal lubricant reservoir.

11. The apparatus according to claim 10 further comprising means connected to said housing and communicating with said reservoir to receive at least a portion of the liquid lubricant from within said reservoir, said means capable of displaying visually, the level of liquid lubricant within said reservoir.

12. The apparatus according to claim 11 further comprising means to selectively introduce liquid lubricant into said reservoir.

13. The apparatus according to claim 12 wherein said liquid lubricant introducing means comprises a removable reservoir plug.

14. The apparatus according to claim 13 further comprising means to selectively introduce a pressurized gaseous medium into said reservoir to raise the level of lubricant from said reservoir upwardly into said peripheral cooling chamber.

15. The apparatus according to claim 14 wherein said pressurization means comprises a needle valve.

16. The apparatus according to claim 15 further comprising means communicable with said reservoir to selectively release gaseous pressure therefrom to selectively vent said reservoir to an atmosphere outside of said housing.

17. The apparatus according to claim 16 wherein said reservoir venting means comprises a manually operable venting valve connected to the upper wall of said housing for selective communication with said reservoir.

18. The apparatus according to claim 17 further comprising means selectively communicable with said peripheral cooling chamber to selectively release air or other gaseous media therefrom.

19. The apparatus according to claim 18 wherein said cooling chamber venting means comprises a manually operable venting valve connected to said upper wall of said housing for selective communication with said cooling chamber.

20. The apparatus according to claim 19 further comprising coupling means connected to an upper portion of said sidewall of said housing, said coupling means being connectable to a liquid transporting means for introducing hot lubricating liquid into said cooling chamber from an external device.

21. The apparatus according to claim 20 further comprising coupling means connected to the lower end wall portion of said housing and capable of being connected to a liquid transporting means for returning relatively cooled lubricant from said housing to an external device requiring lubrication.

22. An apparatus for circulating and cooling a lubricating liquid medium by natural convection, said lubricating medium being continuously utilized for lubricating a device external of the apparatus, comprising a generally tubular housing having at least one generally tubular peripheral outer sidewall portion and axially spaced upper and lower end wall portions connected in fluid-tight relation to the sidewall portion, a generally tubular member positioned within the housing and generally concentric with the peripheral sidewall and having a diameter less than the outer sidewall portion to define an internal reservoir surrounded by a peripheral cooling chamber formed at least in part by the outer peripheral sidewall portion of the housing, said inner tubular member being connected at its upper end to inner surface portions of the upper end wall portion and having its free end spaced upwardly from the lower end wall portion to provide communication between the peripheral cooling chamber and the internal reservoir, means operatively communicating with an upper portion of said cooling chamber to return relatively hot lubricating liquid from an external device to said cooling chamber, means connected to a lower portion of said housing to feed relatively cooled liquid from said housing to an external device thereby permitting liquid entering said housing to be cooled by dissipation of heat through said outer peripheral sidewall portion and to said outside atmosphere and to circulate downwardly within said cooling chamber to said liquid feed means by natural convection, means for introducing at least one of relatively pressurized air and other gaseous media into said reservoir above the level of the lubricating liquid in said cooling chamber sufficient to raise the level of liquid to fill said cooling chamber to a level sufficient to provide a closed convectional liquid loop to enable the liquid to flow steadily downward within said cooling chamber, thereby causing heat to transfer from the lubricating liquid through the peripheral housing sidewall to said outside atmosphere 23. An apparatus for lubricating a mechanical seal assembly positioned between a rotatable shaft and a housing for the shaft, which comprises a housing defined by an enclosed fluid-tight generally tubular container having an outer peripheral sidewall and axially spaced upper and lower end walls welded thereto, a generally tubular member disposed within said container and having one end portion secured in a fluid-tight relationship to inside surface portions of said upper end wall to define an internal lubricant reservoir therewithin and a cooling chamber communicating therewith between said tubular member and said outer peripheral sidewall such that heat is enabled to be transferred from liquid lubricant within said cooling chamber to an external atmosphere, said inner generally tubular member having an open portion spaced upwardly from said lower end wall a distance sufficient to permit circulation of liquid lubricant between said reservoir and said cooling chamber, means to selectively introduce liquid lubricant into said reservoir and for sealing said reservoir with respect to the outside atmosphere, lubricant return means connected to said cooling chamber for enabling lubricant to enter said cooling chamber from a mechanical seal, lubricant feed means operatively connected to a lower portion of said housing for enabling cooled lubricant to recirculate to a mechanical seal, valve means movable from a closed position to an open position to selectively vent said cooling chamber to the outside atmosphere, means to introduce relatively pressurized air into said reservoir to raise and maintain the lubricant in said cooling chamber to a level at least above said lubricant return means to provide a closed loop liquid system and to enable adequate heat transfer to said outside atmosphere from the lubricant returning from a mechanical seal to the cooling chamber thereby permitting the flow of liquid lubricant downwardly within said cooling chamber by natural convection and gravity while dissipating heat through said housing peripheral sidewall to the outside atmosphere until said liquid lubricant reaches said lubricant feed means to be returned to a mechanical seal in the closed loop liquid system.

24. An apparatus for lubricating a mechanical seal device positioned between a rotatable shaft and a housing for the shaft which comprises a generally tubular housing having a peripheral sidewall and axially spaced upper and lower end walls connected in seal relation thereto, a generally tubular member disposed within the tubular housing and having a diameter less than the peripheral sidewall and concentric therewith to define an internal liquid reservoir surrounded by a cooling space, means to connect the upper end portion of said inner tubular member to the underside of the upper end wall, the free end portion of said inner tubular member being spaced from the inner surface portion of the lower end wall to permit communication between said cooling space and said internal reservoir, means to introduce liquid lubricant into said reservoir from the outside, means positioned adjacent an upper portion of said housing to return hot liquid lubricant requiring cooling from a mechanical seal to said peripheral cooling space, means positioned at a lower portion of said housing to feed cooled liquid lubricant to a mechanical seal, means to introduce a pressurized gaseous medium such as air into the upper portion of said reservoir to raise the level of liquid lubricant in said surrounding cooling space at least to a height level above the liquid return means to enable sufficient heat to be transferred from liquid lubricant in said cooling space through said peripheral sidewall to the outside atmosphere and to cause liquid lubricant therein to flow downwardly through a closed loop by natural convection, means to selectively vent said internal reservoir and cooling space, sight glass means connected to said housing to detect the level of liquid lubricant within said internal reservoir, and means to detect and display the pressure of the gaseous medium above the liquid level within said reservoir.

* * * * *

UNITED STATES PATENT AND TRADEMARK OFFICE

CERTIFICATE OF CORRECTION

PATENT NO. : 4,074,752

DATED : February 21, 1978

INVENTOR(S) : Seymour Schlosberg

It is certified that error appears in the above-identified patent and that said Letters Patent are hereby corrected as shown below:

On first page, after [73] Assignee, "R. Gelb & Sons, Inc." should read -- De Dietrich (USA), Inc. --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*

Disclaimer and Dedication 4,074,752.—*Seymour Schlosberg*, East Brunswick, N.J. LUBRICANT COOLING APPARATUS. Patent dated Feb. 21, 1978. Disclaimer and Dedication filed Mar. 14, 1986, by the assignee, *De Dietrich (USA), Inc.*

Hereby disclaims and dedicates to the Public the remaining term of said patent.

[*Official Gazette May 6, 1986.*]